US006425548B2

(12) United States Patent
Christensen et al.

(10) Patent No.: US 6,425,548 B2
(45) Date of Patent: Jul. 30, 2002

(54) KEYED HUB AND CORE FOR RIBBON SUPPLY

(75) Inventors: Christopher R. Christensen, Orlando; Jimmy L. Clemans, Leesburgh; Kenneth Colonel, Oviedo; Mark A. Hitz, Lake Mary, all of FL (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/855,906

(22) Filed: May 15, 2001

Related U.S. Application Data

(60) Provisional application No. 60/204,644, filed on May 17, 2000.

(51) Int. Cl.[7] ..... B65H 75/24; B65H 16/04

(52) U.S. Cl. ..... 242/571.4; 242/597.2; 400/242

(58) Field of Search ..... 242/571.4, 571.5, 242/597.2, 597.3, 611.2, 597.6; 400/242, 613

(56) References Cited

U.S. PATENT DOCUMENTS 3,467,327 A * 9/1969 L'Allemand ..... 242/597.6
3,556,423 A * 1/1971 Steffenini ..... 242/611.2
3,735,941 A * 5/1973 Brown et al. ..... 242/597.2
4,436,256 A * 3/1984 Saitou ..... 242/597.6
5,645,247 A * 7/1997 Voigt ..... 242/571.5
5,833,377 A 11/1998 Keller et al. ..... 400/208
5,947,618 A 9/1999 Kelle et al. ..... 400/613
6,109,801 A 8/2000 Mabit ..... 400/242

* cited by examiner

*Primary Examiner*—John M. Jillions
(74) *Attorney, Agent, or Firm*—Brian A. Lemm; Angelo N. Chaclas; Charles R. Malandra, Jr.

(57) ABSTRACT

A core/hub assembly for a printing device that provides for easy alignment and insertion, and maintains a secure interface to prevent slippage of the core during printer operation, is disclosed. A hub includes keys mounted at a proximal end which serve to transmit torque when engaged with a core. The hub further includes splines configured to be received within a core and provide longitudinal support thereto. A core includes a plurality of longitudinally extending ribs that cooperate to form channels configured to receive the splines of the hub. A portion of the ribs include compliant radially oriented leaf springs which center the core on the hub and provide a physical fit of the core on the hub by engaging the keys at the proximal end of the core when properly inserted therein.

23 Claims, 3 Drawing Sheets

KEYED HUB AND CORE FOR RIBBON SUPPLY

CROSS-REFERENCE TO RELATED APPLICATIONS

This application claims priority from U.S. Provisional Application Ser. No. 60/204,644, entitled "Keyed Ribbon Supply," filed on May 17, 2000, the specification of which is hereby incorporated by reference.

BACKGROUND OF THE INVENTION

1. Field of the Invention

The invention disclosed herein relates generally to printer ribbon supply spools, and more particularly to a core and hub system for securing ribbon supply spools to printers.

2. Background of the Invention

In the field of printer technology, a number of different methods have been developed for applying ink to paper, cards, or other print media in a controlled environment. In addition to standard ink ribbons and hammers as are known in the art, various other printer technologies have also been developed, such as, for example, direct thermal and thermal transfer printing. Although the different printer technologies may differ from each other in significant ways, the different technologies typically have at least two things in common: (i) they typically involve a controlled transfer of the print substance from a substrate onto the print media, and (ii) the act of printing depletes the print substance so that the substrate must periodically be replaced. Accordingly, replaceable ribbons, supply spools, and take-up spools are commonly used in many different types of printers. The term ribbon, as used herein, refers to any type of printer technology that employs a flat, linear material wound around a spool.

Ribbon/spool combinations are usually sold as a single item. Spools are also known as cores. Typically, each core is mounted on a spindle, or hub, for operation, the hub being generally cylindrical in shape and attached to a motor-operated assembly that accurately controls the rotation of the core and ribbon. Since the printer ribbons are required to be replaced, most printers that use ribbons mounted on cores are designed such that the core containing the ribbon can be replaced. It is preferable that such replacement can be completed by a non-technical operator, without the use of tools and with minimal instruction. Accordingly, the design of the core/hub assembly must be such that aligning and inserting the core on the hub and securing the core to the hub are easily performed. Additionally, the interface between the hub and a mounted core should be firm enough to keep the core (and associated ribbon supply) accurately controlled during operation of the printer.

Thus, there exists a need for a core/hub assembly that provides for easy alignment and insertion, and provides for a secure interface to prevent slippage of the core during printer operation.

SUMMARY OF THE INVENTION

The present invention is directed to a core/hub assembly that provides for easy alignment and insertion, and provides for a secure interface to prevent slippage of the core during printer operation.

In accordance with the present invention, a hub includes keys mounted at a proximal end which serve to transmit torque when engaged with a core. The hub further includes splines configured to be received within a core and provide longitudinal support thereto. A core includes a plurality of longitudinally extending ribs that cooperate to form channels configured to receive the splines of the hub. A portion of the ribs include compliant radially oriented leaf springs at one end which center the core on the hub and provide a physical fit of the core on the hub by engaging the keys at the proximal end of the core when properly inserted therein. The core/hub assembly configuration provides for simple loading of the core on the hub and maintains a secure interface between the core and hub to prevent slippage during use.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
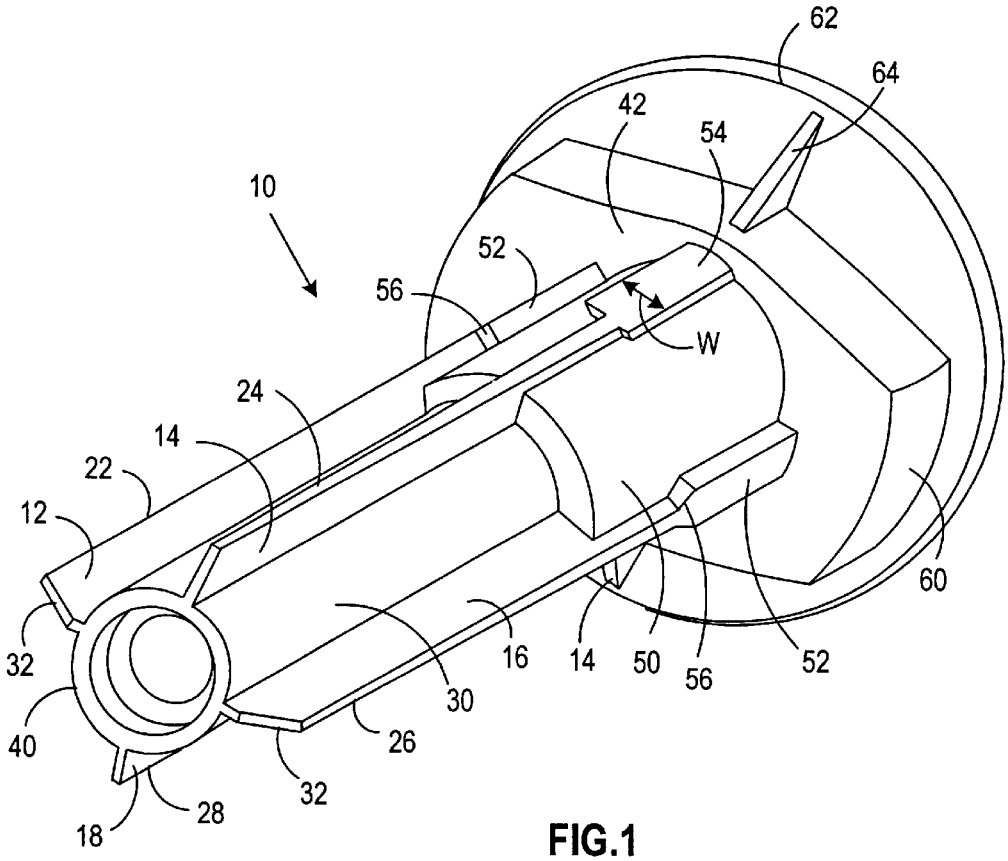
FIG. 1 illustrates an overall view of a hub according to the present invention.
Figure 2:
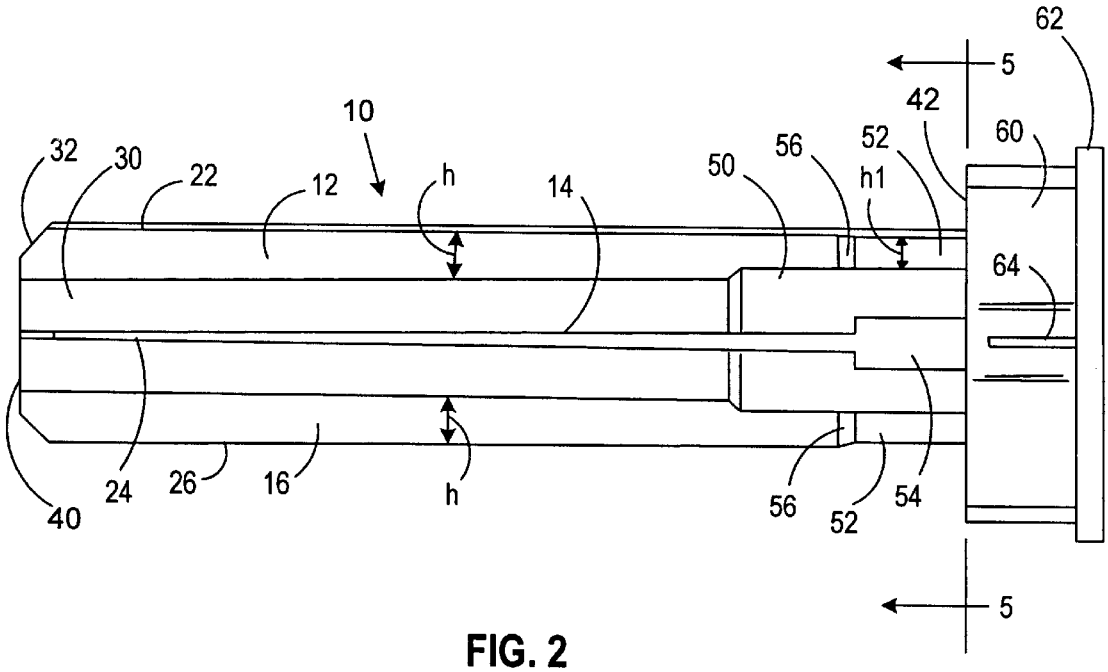
FIG. 2 illustrates a top view of a hub according to the present invention.

In describing the present invention, reference is made to the drawings, wherein there is seen in FIG. 1 a hub 10 according to the present invention and in FIG. 2 a top view of hub 10. Hub 10 includes a plurality of longitudinal splines 12, 14, 16, 18 peripherally spaced on shaft 30. Shaft 30 is cylindrical in shape, and tapers at the distal end 40 of hub 10. Splines 12, 14, 16, 18 can incorporate a radially inward taper 32 as they approach the distal end 40, also referred to as the insertion end 40, of hub 10. Additionally, the thickness of the outer edges 22, 24, 26, 28 of splines 12, 14, 16, 18 tapers as the splines 12, 14, 16, 18 approach the distal end 40 of shaft 30. Preferably, corresponding pairs of splines 12, 14, 16, 18 are provided on opposites sides of shaft 30 spaced at 90 degree intervals. The height of splines 12 and 16, designated as h in FIG. 2, from the shaft 30 is greater than the height of splines 14 and 18 from the shaft 30. It should be noted that while four splines 12, 14, 16, 18 are illustrated, the invention is not so limited and any number of splines may be provided.

A spline hub 50 is provided on the proximate end 42 of shaft 30. Spline hub 50 abuts shaft hub 60, which abuts the shaft hub end 62. Shaft hub 60 and shaft hub 62 are configured to attach hub 10 to a drive mechanism (not shown), such as the shaft of a servo motor of a printing device. Preferably, the mounting is accomplished by slots and grooves (not shown) in the shaft hub 60 and shaft hub end 62 and the interior of shaft 30. One or more strengthening ribs 64 may be provided between shaft hub 60 and shaft hub end 62.

Each of the splines 12, 14, 16, 18 terminates in a key 52, 54. Preferably, key 52 is provided on the pair of splines on opposite sides of shaft 30, i.e., splines 12 and 16, while key 54 is provided on the other pair of splines, i.e., splines 14, 18. Keys 52 may be provided with a shoulder 56. Each of keys 54 is generally rectangular shaped and raised slightly from the surface of spline hub 50, abutting against the shaft hub 60 as illustrated. Each of keys 52 is also generally rectangular shaped with a tapering end to form shoulder 56 where key 52 meets spline 12, 16. Each of keys 52 is also raised from the surface of spline hub 50, with the height of keys 52, designated h1 in FIG. 2, from the surface of spline hub 50 being greater than the height of keys 54 from the surface of spline hub 50. Preferably, the height of keys 54 is approximately twice that of keys 52. Additionally, the width of keys 54, designated w in FIG. 1, is preferably greater than the width of keys 52.

Figure 3A:
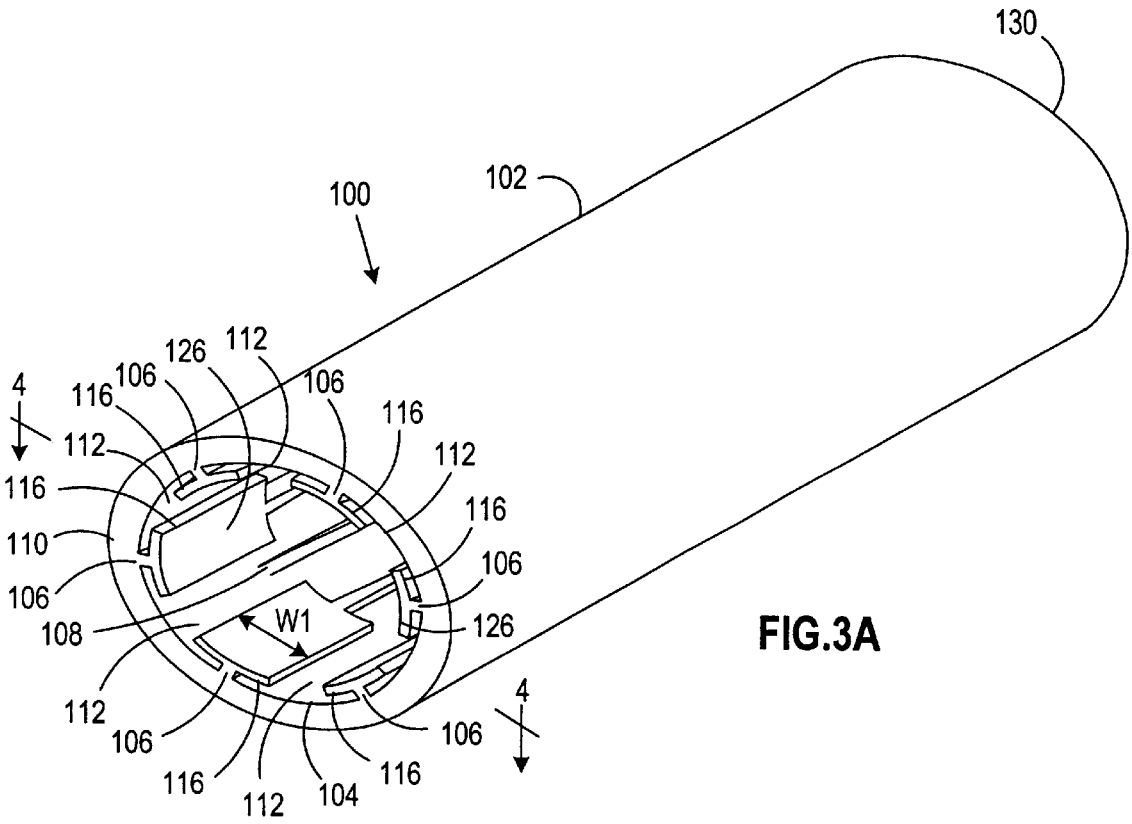
FIG. 3A illustrates an overall view of a core according to the present invention viewed from one end.
Figure 3B:
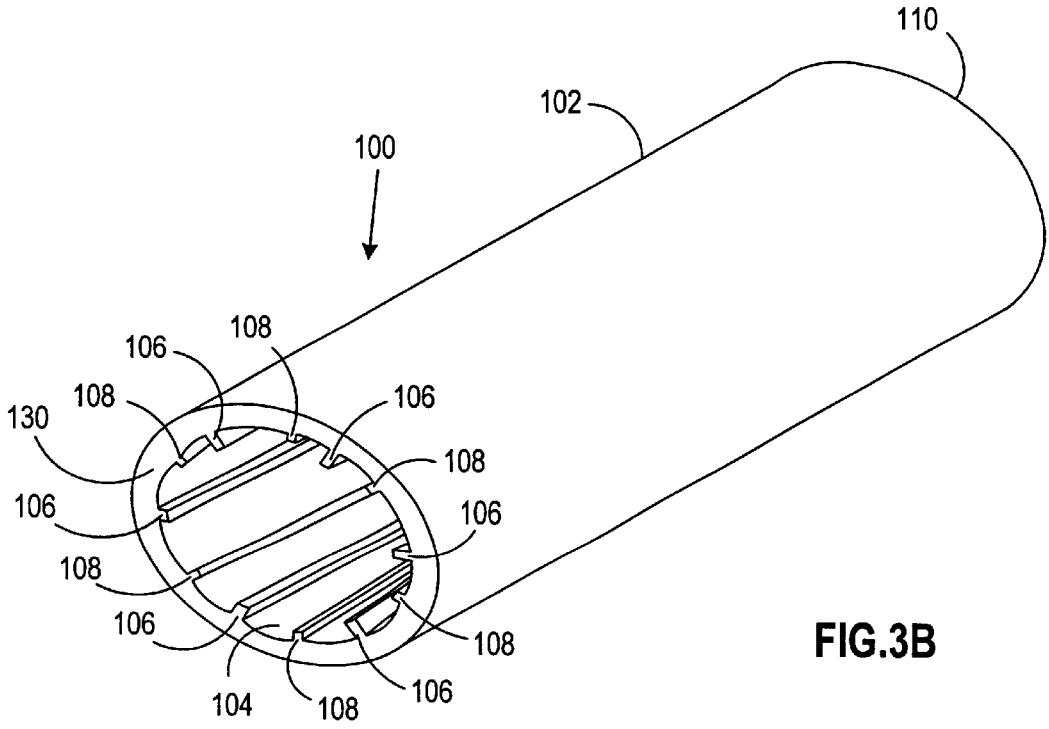
FIG. 3B illustrates an overall view of a core according to the present invention viewed from the other end.
Figure 4:
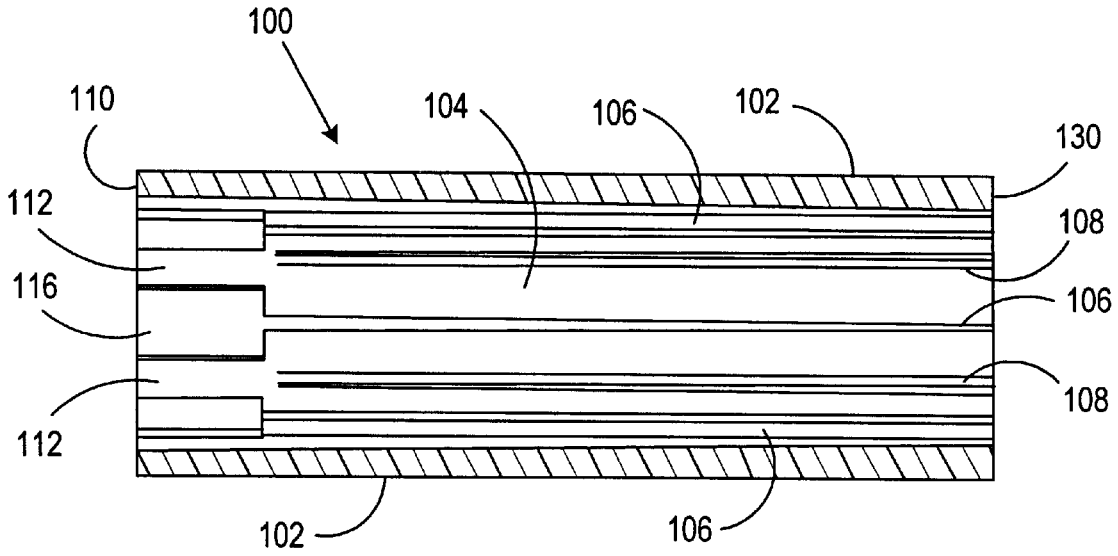
FIG. 4 illustrates a cross-section of the core according to the present invention taken along line 4—4 of FIG. 3A.

FIG. 3A illustrates the mounting end 110 at one of a core 100 according to the present invention, while FIG. 3B illustrates the distal end 130 of core 100. Core 100 is generally cylindrical in shape and adapted to be placed onto hub 10 via the insertion end 40 of hub 10. Core 100 serves as the spool for an ink ribbon (not shown) which is typically wrapped around the outer surface 102 of core 100. Once the end of the ribbon is attached to core 100 through any appropriate means, the ribbon can be wound or unwound from outer surface 102. As illustrated in FIG. 3B, the interior surface 104 of core 100 is provided with a plurality of ribs 106, 108 running longitudinally along the inner surface 104. In a preferred embodiment, there are six ribs 106 and six ribs 108, equally spaced and alternating around the inner surface 104 of core 100. The height of ribs 106 is greater than the height of ribs 108. Ribs 106 run the entire length of core 100, while the ribs 108 slope towards inner surface 104 and ribs 108 terminate before the mounting end 110 as illustrated in FIGS. 3A and 4. Additionally, as illustrated in FIG. 4A, the width of ribs 106 preferably tapers as the rib runs from the mounting end 110 to the distal end 130.

Ribs 106 from a plurality of longitudinal extending channels 112 which are configured to receive a respective spline 12, 16 of hub 10. Each of ribs 106 terminates at mounting end 110 in an integral radially oriented compliant leaf spring 116. Each leaf spring 116 extends outwardly to each side of its respective rib 106, and has a slight curvature that parallels the curvature of inner surface 104 of core 100. Leaf springs 116 further define channels 112. The width of springs 116, designated as w1 in FIG. 3A, is preferably slightly greater than the width w of key 54.

The operation of hub 10 and core 100 is as follows. The width of the hub 10 as measured across hub 10 from the top edge 22 of spline 12 to the top edge 26 of spline 16 is greater than the diameter of core 100 as measured between the inner surface 126 of a first spring 116 and the inner surface 126 of a second spring 116 located on the opposite side of inner surface 104, but less than the full diameter of the inner surface 104 of core 100. The width of the hub 10 as measured from the top edge 24 of spline 14 to the top edge 28 of spline 18 is less than the diameter of core 100 as measured between the inner surface 126 of a first spring 116 and the inner surface 126 of a second spring 116 located on the opposite side of inner surface 104. Accordingly, when the mounting end 110 of core 100 is placed onto the insertion end 40 of hub 10, the splines 12, 16 will only fit in the channels 112 created by the springs 116 and ribs 106. Thus, if an operator incorrectly aligns the splines 12, 16 with the springs 116, the core 100 need only be rotated at most 45 degrees to properly align the splines 12, 16 with a pair of corresponding channels 112. This allows for simple loading of the core 100 onto hub 10, and avoids the problem encountered with conventional core/hub combinations in which the core must be rotated up to 180 degrees by the operator before the core can be inserted onto the hub.

When the splines 12, 16 are aligned with a pair of corresponding channels 112 in core 100, the splines 14, 18 will be aligned with a corresponding pair of springs 116. As noted above, the width of the hub 10 as measured from the top edge 24 of spline 14 to the top edge 28 of spline 18 is less than the diameter of core 100 as measured between the inner surface 126 of a first spring 116 and the inner surface 126 of a second spring 116 located on the opposite side of inner surface 104. Accordingly, as the core 100 is inserted onto the hub 10 in a longitudinal direction, the splines 12, 16 will be guided by a corresponding pair of channels 112 and the spines 14, 18 will be adjacent to a corresponding pair of springs 116. As the insertion end 110 of core 100 approaches the shaft hub 60, the keys 52 on splines 12, 16 will be captured between the outer edges of the adjacent springs 116 that form the respective channel 112 into which the splines 12, 16 are inserted. Additionally, the keys 54 of splines 14, 18 will engage the inner surface 126 of the springs 116 to which splines 14, 18 were adjacent. When the keys 54 engage the inner surface 126 of springs 116, the outer edges of the springs 116 are urged towards the inner surface 104 of core 100 as the curvature of springs 116 is reduced due to the pressure of the engaging keys 54. The pressure between the springs 116 and keys 54 provides a snug fit of core 100 onto hub 10. The mounting end 110 of core 100 will be adjacent to, and preferably abuts against, shaft hub 60 when fully inserted.

Figure 5:
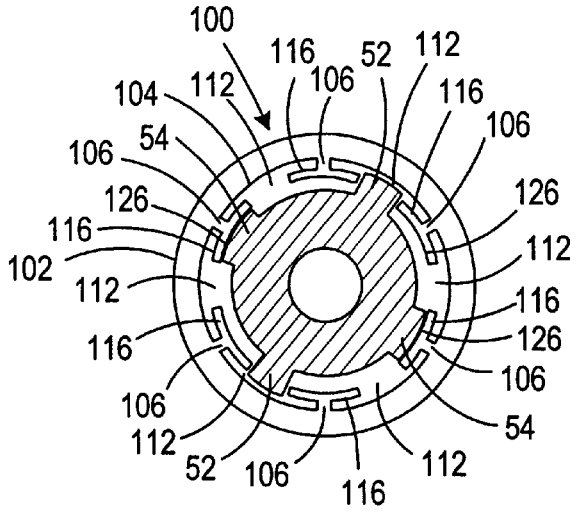
FIG. 5 illustrates a cross-sectional view of the core mounted on the hub according to the present invention taken along line 5—5 of FIG. 2.

FIG. 5 illustrates a cross sectional diagram of a hub 10 taken across the line 5—5 of FIG. 2 when a core 100 is fully mounted. As shown in FIG. 5, the keys 52 are caught in corresponding channels 112 adjacent to the edges of the springs 116 defining the channels 112. The catching of keys 52 between the edges of springs 116 serves to transmit torque from the hub 10 to the core 100 and prevents rotational slippage of the core 100. Keys 54 are engaged with a corresponding pair of springs 116, and the pressure from springs 116 exerted on keys 54 effectively secures core 100, preventing both longitudinal and rotational movement of core 100 with respect to hub 10 and additionally serves to transmit torque from the hub 10 to core 100. The catching of keys 52 between corresponding springs 116 and the engagement of keys 54 by corresponding springs 116 provides a secure interface between the core 100 and hub 10 to prevent slippage during use.

It should also be noted that the core 100 and hub 10 of the present invention allow an operator to easily determine that the core 100 is inserted onto the hub 10 in the wrong direction, i.e., the mounting end 110 of core 100 is not adjacent the shaft hub 60. If an operator slides the distal end 130 of core 100 onto hub 10, the keys 52 will not be caught between corresponding springs 116 and the keys 54 will not be engaged by corresponding springs 116. Accordingly, the core 100 will exhibit both longitudinal and rotational movement with respect to hub 10, thereby indicating to the operator that the core 100 is not properly mounted on the hub 10.

Thus, according to the present invention, a core/hub assembly that provides for easy alignment and insertion, and provides for a secure interface to prevent slippage of the core during printer operation, is provided.

While a preferred embodiment of the invention has been described and illustrated above, it should be understood that this is exemplary of the invention and is not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A ribbon core and hub assembly comprising:

a hub comprising:

a plurality of longitudinal splines, a first portion of said plurality of splines having a first key, a second portion of said plurality of splines having a second key; and a core comprising:

a first plurality of longitudinal ribs, said first plurality of ribs having a respective leaf spring at a first end of said core, adjacent pairs of said leaf spring and respective ribs forming a respective channel in said core, wherein when said core is mounted on said hub, at least one respective leaf spring engages a respective first key and applies pressure thereto, and at least one said adjacent pair of said leaf springs receives said second key in said formed channel, thereby securing said core to said hub.

2. The ribbon core and hub assembly according to claim 1, wherein said first and second portions of said plurality of splines are each provided in respective corresponding pairs of splines located on opposite sides of said hub.

3. The ribbon core and hub assembly according to claim 2, wherein said hub has a first diameter measured across one of said corresponding pairs of said first portion of said plurality of splines, and a second diameter measured across one of said corresponding pairs of said second portion of said plurality of splines, said second diameter being greater than said first diameter.

4. The ribbon core and hub assembly according to claim 1, wherein said first key is raised from said hub a first height, and said second key is raised from said hub a second height, said second height being greater than said first height.

5. The ribbon core and hub assembly according to claim 1, wherein said plurality of splines includes four splines, said first portion of said plurality of splines includes a first pair of splines located on opposite sides of said hub, and said second portion of said plurality of splines includes a second pair of splines located on opposite sides of said hub and spaced equidistant from said first pair of splines.

6. The ribbon and core assembly according to claim 1, wherein a width of said plurality of splines tapers on an end opposite said first and second keys.

7. The ribbon core and hub assembly according to claim 1, wherein said core further comprises:

a second plurality of longitudinal ribs, each of said second plurality of ribs being located in a respective channel.

8. The ribbon and core assembly according to claim 7, wherein said second plurality of ribs terminate before reaching said first end of said core.

9. The ribbon and core assembly according to claim 7, wherein said first plurality of ribs have a first height, and said second plurality of ribs have a second height, said first height being greater than said second height.

10. The ribbon and core assembly according to claim 1, wherein said first plurality of ribs includes six ribs, each of said six ribs having a respective leaf spring at said one end of said core.

11. A core adapted to be removably mounted on a hub, said hub having a plurality of splines, a first key on at least one of said plurality of splines and a second key on at least another of said plurality of splines, said core comprising:

a first plurality of longitudinal ribs, said first plurality of ribs having a respective leaf spring at a first end of said core, adjacent pairs of said leaf spring and respective ribs forming a respective channel in said core, wherein when said core is mounted on said hub, at least one of said respective leaf springs engages said first key and applies pressure thereto, and at least one adjacent pair of said leaf springs receives said second key in said formed channel, thereby securing said core to said hub.

12. The core according to claim 11, further comprising:

a second plurality of longitudinal ribs, each of said second plurality of ribs being located in a respective channel.

13. The core according to claim 12, wherein said second plurality of ribs terminate before reaching said first end of said core.

14. The core according to claim 12, wherein said first plurality of ribs have a first height, and said second plurality of ribs have a second height, said first height being greater than said second height.

15. The core according to claim 11, wherein said first plurality of ribs includes six ribs, each of said six ribs having a respective leaf spring at said one end of said core.

16. The core according to claim 11, further comprising:

an outer surface adapted to have a ribbon secured thereto, said ribbon being wound around said outer surface of said core.

17. A hub for mounting a ribbon/core assembly, said hub comprising:

a plurality of longitudinal splines, a first portion of said plurality of splines having a first key, said first key being raised from said hub a first height, a second portion of said plurality of splines having a second key, said second key being raised from said hub a second height, said second height being greater than said first height.

18. The hub according to claim 17, wherein said first and second portions of said plurality of splines are each provided in respective corresponding pairs of splines located on opposite sides of said hub.

19. The hub according to claim 18, wherein said hub has a first diameter measured across one of said corresponding pairs of said first portion of said plurality of splines, and a second diameter measured across one of said corresponding pairs of said second portion of said plurality of splines, said second diameter being greater than said first diameter.

20. The hub according to claim 17, wherein when said ribbon/core assembly is mounted on said hub, said first key is adapted to engage a respective leaf spring of said ribbon/core assembly, said leaf spring applying pressure to said first key, and said second key is adapted to be received in a channel formed by adjacent leaf springs of said ribbon/core assembly, thereby securing said ribbon/core assembly to said hub.

21. The hub according to claim 17, wherein said plurality of splines includes four splines, said first portion of said plurality of splines includes a first pair of splines located on opposite sides of said hub, and said second portion of said plurality of splines includes a second pair of splines located on opposite sides of said hub and spaced equidistant from said first pair of splines.

22. The hub according to claim 17, wherein a width of said plurality of splines tapers on an end opposite said first and second keys.

23. A core and hub assembly, said core adapted to be mounted on said hub, said core comprising a plurality of ribs, each of said plurality of ribs having an integral leaf spring at one end of said core, adjacent leaf springs forming a channel, said hub comprising a plurality of splines, each of said plurality of splines having a first or second key, wherein when said core is mounted on said hub, at least one respective leaf spring engages a respective first key and applies pressure thereto, and at least one adjacent pair of said leaf springs receives said second key in said formed channel, thereby securing said core to said hub.

* * * * *